US005251362A

United States Patent [19]

Riceman et al.

[11] Patent Number: 5,251,362

[45] Date of Patent: Oct. 12, 1993

[54] MAGNETIC LATCH

[75] Inventors: Robert G. Riceman, West Caldwell, N.J.; Mitchell A. Medina, New York, N.Y.

[73] Assignee: Randolph-Rand Corporation, New York, N.Y.

[21] Appl. No.: 944,711

[22] Filed: Sep. 11, 1992

Related U.S. Application Data

[63] Continuation of Ser. No. 705,036, May 24, 1991, abandoned.

[51] Int. Cl.[5] ..... H01F 7/02

[52] U.S. Cl. ..... 24/303

[58] Field of Search ..... 24/303, 49 M; 292/251.5; 248/206.5; 335/285

[56] References Cited

U.S. PATENT DOCUMENTS

| | | |
|---|---|---|
| 2,812,203 | 11/1957 | Scholten . |
| 2,884,698 | 5/1959 | Wursch . |
| 3,372,443 | 3/1968 | Daddona, Jr. . |
| 3,618,174 | 11/1971 | Schainholz et al. . |
| 4,021,891 | 5/1977 | Morita . |
| 4,453,294 | 6/1984 | Morita . |
| 4,455,719 | 6/1984 | Morita . |
| 4,458,396 | 7/1984 | Aoki . |
| 4,700,436 | 10/1987 | Morita . |
| 4,754,532 | 7/1988 | Thomson et al. . |
| 4,825,526 | 5/1989 | Shenier et al. . |

FOREIGN PATENT DOCUMENTS

| | | | |
|---|---|---|---|
| 1127509 | 6/1957 | Fed. Rep. of Germany . | |
| 58-105508 | 6/1983 | Japan | 335/285 |
| 58-121610 | 7/1983 | Japan | 335/285 |
| 59-11306 | 6/1984 | Japan | 335/285 |
| 61-93606 | 5/1986 | Japan | 335/285 |
| 61-141101 | 6/1986 | Japan | 335/285 |
| 61-219111 | 9/1986 | Japan | 335/285 |
| 61-251008 | 11/1986 | Japan | 335/285 |
| 143646 | 1/1954 | Sweden . | |

*Primary Examiner*—James R. Brittain

*Attorney, Agent, or Firm*—Foley & Lardner

[57] ABSTRACT

A magnetic latch includes a first member having a protrusion and a second member engaging the protrusion to prevent the first member and the second member from sliding relatively to one another. The second member includes a first magnet to attract the first member and a first solid non-magnetic member located inside a cavity of the first magnet to enhance attraction between the first member and the second member. The second member can be provided with a backing plate to facilitate a magnetic flux path from the magnet to the magnet aperture. The second member can also include a second magnet to attract the first member and a second solid non-magnetic member located between the first magnet and the second magnet. A third solid non-magnetic member can be provided on the outer periphery of the magnets. This design provides a latch with stronger holding power.

22 Claims, 20 Drawing Sheets

MAGNETIC LATCH

This application is a continuation of application Ser. No. 07/705,036, filed May 24, 1991, now abandoned.

BACKGROUND OF THE INVENTION

The invention is directed to a magnetic latch. More specifically, the invention is directed to a magnetic latch which is stronger and more environmentally resistant than conventional magnetic latches.

Magnetic latches use magnetic force to hold two objects together. U.S. Pat. No. 4,021,891 issued to Morita on May 10, 1977, U.S. Pat. No. 4,453,294 issued to Morita on Jun. 12, 1984, U.S. Pat. No. 4,455,719 issued to Morita on Jun. 26, 1984, U.S. Pat. No. 4,700,436 issued to Morita on Oct. 20, 1987, U.S. Pat. No. 4,458,396 issued to Aoki on Jul. 10, 1984, U.S. Pat. No. 2,812,203 issued to Scholten on Nov. 5, 1957, U.S. Pat. No. 3,372,443 issued to Daddona on Mar. 12, 1968, and U.S. Pat. No. 3,618,174 issued to Schainholz on Nov. 9, 1971 disclose examples of conventional magnetic latches. U.S. Pat. No. 2,884,698 issued to Würsch on May 5, 1959 discloses a magnetic holding device for holding two pieces of metal together.

The latching strength of these conventional latches limits their utility. The latching strength of these latches may be increased by increasing the size of the latch. However, as the size of the latch increases, the usefulness of the latch in many applications decreases due to the bulkiness of the latch. In addition, larger latches are more expensive to manufacture, thereby reducing the cost effectiveness of larger latches.

Another disadvantage of these conventional magnetic latches is their unsuitability for use in a harsh environment. Generally, these conventional latches contain numerous cracks and crevices which collect caustic materials which corrode the latch parts and degrade its effectiveness. In a salt-air environment, the crevices in these conventional latches collect salt and other corrosive materials which ultimately corrode the latch parts. Thus, using these conventional latches to hold sails in place would be ineffective. Similar problems occur when using magnetic latches in a caustic chemical environment, for example, when using magnetic latches to seal protective clothing. Even the environment of a washing machine will cause most prior art magnetic latches to rust, limiting their usefulness on garments.

Many of the potential applications for magnetic latches require that the latch be resistive to lateral force. Therefore, magnetic attachment devices which do not resist lateral force, such as the device disclosed in the '698 patent cited above, are unsuitable for such applications.

SUMMARY OF THE INVENTION

It is an object of the invention, therefore, to provide a magnetic latch which has a strong latching force as compared with conventional latches similar in size.

It is another object of the invention to provide a magnetic latch which is smaller in overall size than conventional latches having the same latching force.

Another object of the invention to provide a magnetic latch which is thinner than conventional latches having the same latching force.

A further object of the invention is to provide a latch which can withstand water and/or caustic environments.

Yet another object of the invention is to provide a magnetic latch which resists lateral force.

According to a first aspect of the invention, there is provided a magnetic latch having a first member and a second member. The first member includes magnetically attractable material. The first and/or second members include a mechanism for preventing the lateral movement of the first member relative to the second member when said first and second members are latched together. The said second member includes a first magnet to attract the first member, wherein the first magnet defines therein a cavity. The second member also includes a first solid non-magnetic member arranged inside of the cavity to enhance attraction between said first member and said second member. A solid insulating member can be located on an inner periphery of the magnet cavity, and further solid non-magnetic members can be arranged on an outer periphery of the magnet or elsewhere as described below. In a preferred embodiment the solid insulating member is in the shape of an open-ended cylinder.

The magnet and the solid insulating member may be integrally bonded together to resist corrosion. For certain applications the latch components are not bonded together.

According to another aspect of the invention, there is provided a magnetic latch which includes a first member having a protrusion and a second member engaging the protrusion to prevent the first member and the second member from sliding relatively to one another. The second member includes first and second magnets to attract the first member. A solid insulating member is located between the first magnet and the second magnet to enhance attraction between the first member and the second member.

The first magnet and the solid insulating member are integrally bonded together and the second magnetic and the solid insulating member are integrally bonded together. In certain applications the components are not integrally bonded together.

The provision of two or more concentric magnets, separated by solid insulating members, allows for reversal of the polarity of the magnets from magnet to magnet, further increasing the latching strength.

Other objects, features, and advantages of the invention will be apparent from the following detailed description.

BRIEF DESCRIPTION OF THE DRAWINGS

The invention will be described in further detail below with reference to the drawings, wherein.

DETAILED DESCRIPTION OF THE PREFERRED EMBODIMENTS

Figure 1:
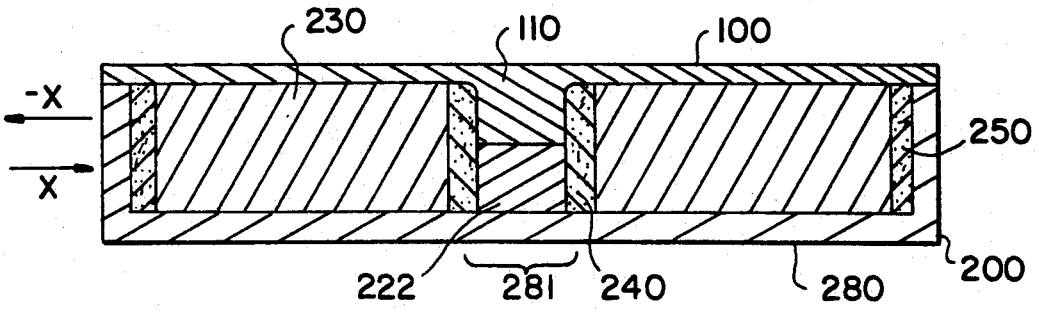
FIG. 1 illustrates a cross section of a first preferred embodiment of the invention.

FIG. 1 illustrates, in cross section, a first preferred embodiment of a magnetic latch according to the invention. As illustrated in FIG. 1, the magnetic latch includes a first, or male, member 100 and a second, or female, member 200. When the magnetic latch is unlatched, the first member 100 and the second member 200 are separated. When the magnetic latch is latched, the first member 100 and the second member 200 are connected together as illustrated in FIG. 1.

The first member 100 is generally planar in shape and is magnetically attractable. For example, it may be formed from a ferromagnetic material such as iron or an iron-based material. The first member 100 has a protruding segment 110 positioned at the center of the first member. Although, the protruding segment 110 is shown integral with the remaining portions of the first member 100, it may be separately formed and connected thereto. In most embodiments, it is important that at least this protruding segment 110 be magnetically attractable although generally the entire first member will be magnetically attractable e g., made of a ferromagnetic material. Protruding segment 110 engages the second member 200 to prevent the first member and the second member from moving radially (sliding) relatively to one another—in the plane of the view of FIG. 1, to prevent movement in the positive and negative x directions as indicated by the arrows.

Figure 2:
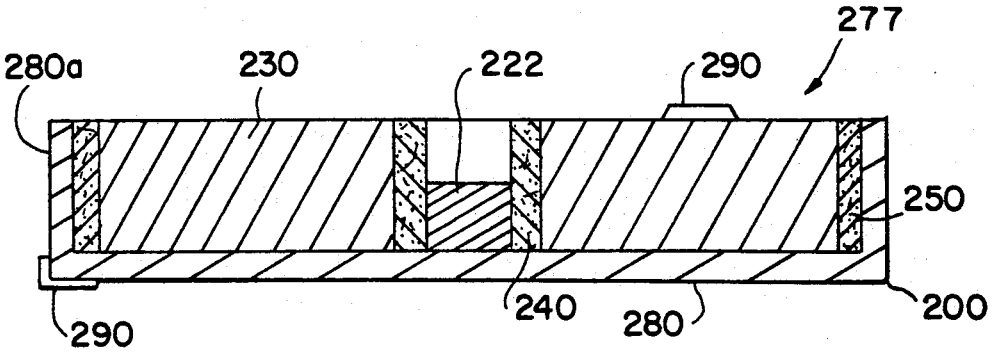
FIG. 2 illustrates a cross section of the second member of the FIG. 1 preferred embodiment.
Figure 3:
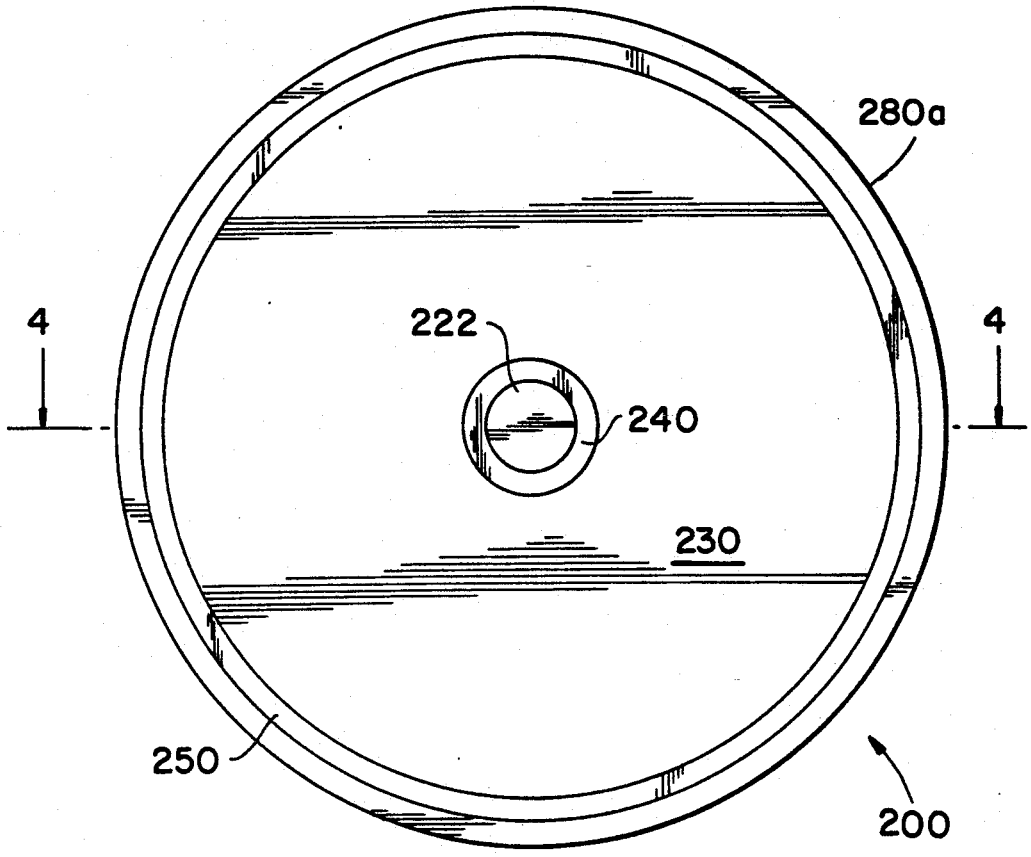
FIG. 3 illustrates a plan view of the second member of the FIG. 1 preferred embodiment.
Figure 4:
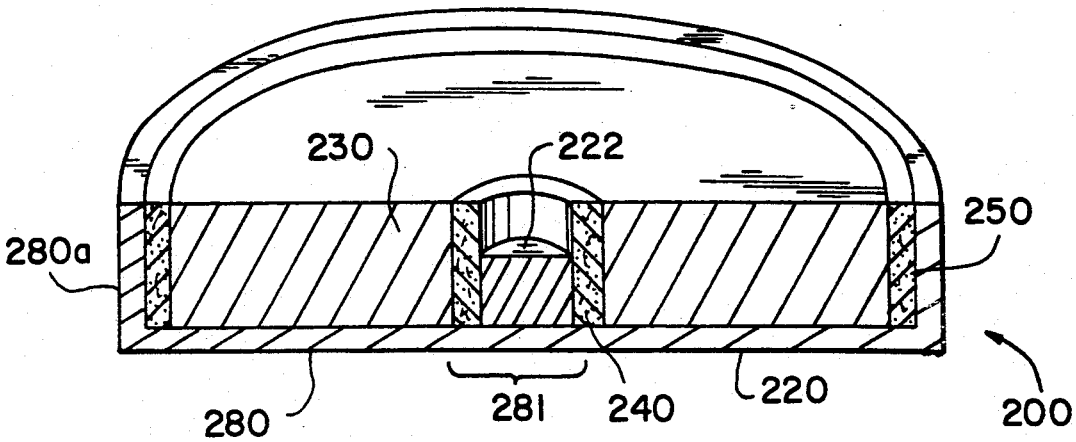
FIG. 4 illustrates a perspective view of the second member of the FIG. 1 preferred embodiment.

FIGS. 2, 3, and 4 illustrate the construction of second member 200, with the first member 100 removed for clarity. FIG. 2 is a cross sectional view of second member 200. FIG. 3 is a top, or plan, view of second member 200. FIG. 4 is a perspective view of second member 200 partially in section. As seen in FIG. 1, and more particularly in FIGS. 2-4, the second member comprises a center section 222, made, for example, from a ferromagnetic material, a magnet 230 having an aperture centrally located therein, and a first segment 240 made of a magnetically insulating material. The first segment 240 is a ring like member, positioned within the magnet aperture against the inner periphery of the magnet 230, and separates the magnet 230 from the central section 222. There may also optionally be provided a second section 250 also made of a magnetically insulating material. The second section 250 is also a ring like member and surrounds the outer periphery of the magnet 230. A backing plate 280, made of ferromagnetic material for example, is provided to concentrate magnetic flux from the magnet into the magnet aperture to increase the overall attractive power of the latch. Additionally, the backing plate 280 may serve to secure the magnet 230 and segments 240 and 250. A central portion 281 of the backing plate is aligned with the aperture in the magnet 230. The backing plate may have a rim 280*a* as illustrated. The magnet 230, first segment 240, center section 222 and second segment 250 may be pressure fit within the housing defined by the backing plate 280 and rim 280*a*. When the latch is in a closed position as illustrated in FIG. 1, the protruding segment 110 and the center section 222 contact or come into proximity with one another, and the bottom surface of the plate-like member of first member 100 contacts or comes into proximity with the surface of magnet 230.

It is readily apparent that many variations of the first embodiment as illustrated in FIGS. 1-4 may also possible. For example, although these figures show that the first segment 240 is in the shape of an open-ended cylinder (top end open) with a circular cross section, it is apparent that the aperture defined within the magnet 230 may be of oval cross section or any other shape with the first segment 240 being of any shape adapted to fit within the aperture, and with the center section 222 being of any shape adapted to fit within the first segment 240.

Figure 5A:
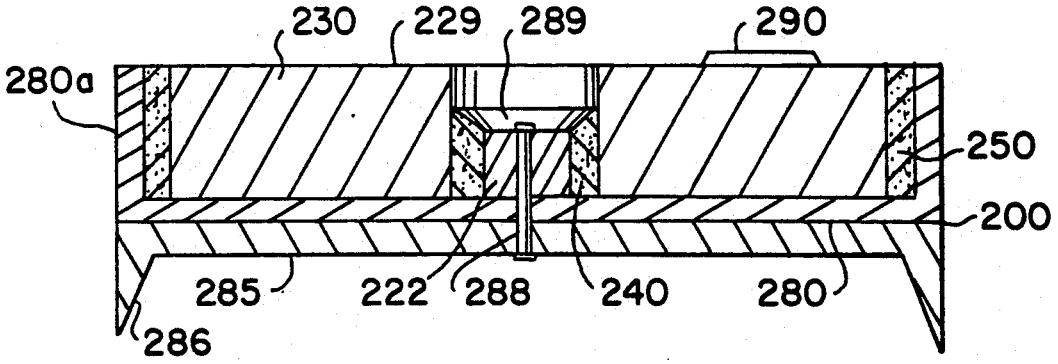
FIGS. 5A, 5B and 5C illustrate modifications of the second member of the FIG. 1 preferred embodiment.

Further, while the first segment 240 has been illustrated as extending through the entire longitudinal length of the hole defined by the magnet 230, it may extend only from the bottom thereof and up to a point where its top surface is co-extensive with the top surface of the center section 222 as shown in FIG. 5A. In such a case, the first segment 240 may have a tapered top surface as illustrated in FIG. 5A or may be untapered (flat).

Further, the magnet aperture need not be positioned centrally in the magnet, but could be off-center and still exhibit the enhanced magnetic attractiveness characteristic of the invention. In such a case protruding segment 110 would likely be off-center as well in a manner comparable to the positioning of the aperture. However, it is not absolutely necessary for closure of the latch that the protruding segment 110 have a longitudinal symmetry axis coincident with the symmetry axis of the aperture, especially where different cross sectional shapes are used for the protruding segment and the aperture.

An additional modification may take the form of a change in the shape of the latch as a whole. While the first embodiment of FIGS. 1–4 show a generally circular shape, the latch can be formed in any shape necessary to suit a particular application. For example, the latch can be rectangularly shaped in which case first segment 240 may be in the shape of an open-ended rectangle. In general, first segment 240 can be shaped in the shape of any open-ended polygon.

Figure 5B:
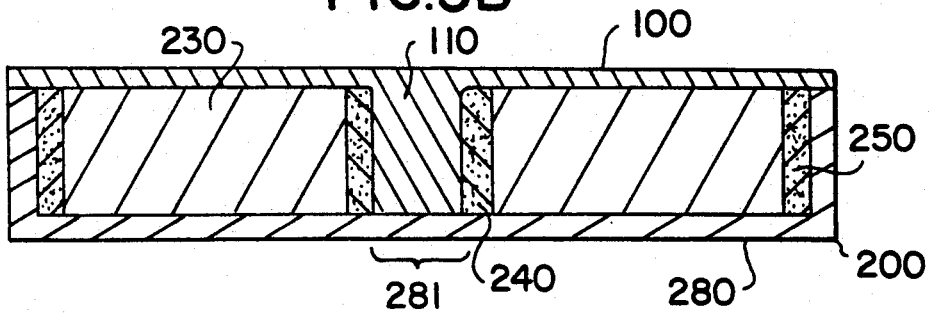

Another modification involves altogether deleting center section 222. In this embodiment, segment 110 of the first member 100 is preferably long enough to go all the way through the aperture in magnet 230 so as to be positioned closely adjacent to or in contact with the center portion 281 of backing plate 280 when the latch is closed, thus maximizing the holding power of the latch. In this case, the first segment 240 extends the full longitudinal length of the magnet aperture thus separating and substantially completely filling the space between the protruding segment 110 and the inner surface of the magnet aperture. This modification of the first embodiment is shown in FIG. 5B. However, in some embodiments, adequate holding power is developed through other points of contact (e.g. the outer periphery of magnet 230), and protruding segment 110 need not extend all the way through aperture 230.

It is also apparent that the length of the center section 222 may extend through the longitudinal length of the aperture of the magnet 230 so as to just contact the protruding segment 110 when the latch is closed (latched), as in FIG. 1, or it may alternately be spaced slightly therefrom but still closely adjacent thereto. The abutment or close positioning of these two members when the latch is closed assist in maintaining a strong closure force. Segments 240 and 250 concentrate magnetic force produced by magnet 230 into localized areas in and around the second member 200 to enhance the attractive force between first member 100 and second member 200. More specifically, the first segment 240 focuses magnetic flux toward the center of the latch, in the aperture in magnet 230, either through center section 222 or through the center portion 281 of backing plate 280, or through both. In this connection it is useful to minimize the amount of magnetically insulating material in the flux paths through center section 222 and center portion 281 to maximize the latching force.

In most embodiments of the invention, the positioning of the first segment 240 in combination with the protruding segment 110 and the center section 222 is such as to substantially fill the aperture when the first and second members 100 and 200 respectively are in the latched position. A clearance which may be quite small is provided to permit the protruding segment 110 to slide longitudinally within the aperture defined by the interior walls of the first segment 240. In most embodiments, as for example in FIG. 1, substantially the entire space between the outer surface of the protruding segment 110 and the inner surface of the magnet 230 defining the magnet aperture is occupied by the first segment 240. Likewise, substantially the entire space between the outer surface of the center section 222 and the inner surface of the magnet 230 defining the magnet aperture is occupied by the first segment 240 which extends continuously across the entire inner surface of the magnet defining the magnet aperture. Such a positioning of the first segment 240 enhances the attractive power of the latch as compared to devices in which there exists an air space between the protruding member 110 and the inner surface of the magnet defining the magnet aperture.

Second segment 250 reduces the fringe field which would normally exist outside of the outer perimeter of the magnet and concentrates the magnetic lines of force so that they have a higher density in the region at and above the perimeter itself, namely, in the region indicated by number 277 in FIG. 2, and in the rim **280*a*** when such are provided.

The net effect of these two segments, or rings, whether a given embodiment contains one, the other or both, is to enhance the latching force for a given size magnet. Since the latching force is enhanced over comparably dimensioned latches not made in accordance with the invention, the overall size of the inventive latch can be made smaller in size, either the radial (i.e., cross sectional area) extent or thickness or a combination of both. A smaller size latch constitutes a distinct advantage over existing latches of larger size in enabling wider application of the latch such that it may be employed for use in items of clothing and the like. Moreover, since magnetic force is concentrated in the central and peripheral regions of the magnet 230, the attraction between the first member and the second member is minimized when the first and second members are not properly lined up, and is maximized when they are in alignment.

The embodiment, thus, provides a latch which has a stronger latching force for a given latch size or, alternatively, allows the use of a smaller latch in an application which requires a particular latching force.

In the first preferred embodiment, center section 222 may be constructed from an iron-based material and may be a permanent magnet integral with or distinct from magnet 230. The center section 222 can be formed from other ferromagnetic materials as well. The specific materials used for constructing the backing plate 280 and rim **280*a* depend on the particular application, but in general they will be made of a ferromagnetic material. In some applications, however, particularly where the rim 280*a* is utilized, the center section 222 and even the protruding segment 110 need not be ferromagnetic. Most preferably, the insulating effects between the backing plate 280, rim 280*a* and the magnet 230 are minimized, for example, by having them be in close contact, so as not to interfere with the passage of magnetic flux from the magnet 230 to the backing plate 280. The backing plate 280 and rim 280*a*** may be constructed from corrosion-resistant material such as stainless steel. Other materials are also possible for use in the backing plate. Preferably, these other materials readily conduct magnetic flux or at least are not flux insulators.

The segments 240 and 250 are made of any solid material which does not readily conduct magnetic flux. Such materials will be termed non-magnetic materials, or alternatively, magnetically insulating materials. Segments fabricated from such non-magnetic materials provide the latch with an enhanced magnetic attractive force in localized regions of the latch. By way of example, and not by way of limitation, the segments 240 and 250 may be formed from a composition containing zinc or tin, and a carrier such as a ceramic material or a polymer. The presence of small amounts of ferromagnetic material or responsiveness, such as the use of nickel, in the insulating material does not negatively impact functioning of the latch in an appreciable way.

FIG. 5A illustrates a further modification of the FIG. 1 embodiment and includes a tapered first segment 240 and a fastener 285 having prongs 286. The prongs are a non-limiting example of a suitable fastening mechanism to attach the second member to an element desired to be fastened, such as an article of clothing, handbag, etc. A similar fastener, not shown, can be secured to the first member 100 to secure it to a different portion of the article desired to be fastened. FIG. 5A also shows a rivet 288 passing through an aperture in the center section 222 to secure the center section 222, backing plate 280 and fastener 285 together. Further, a waterproof film, as for example an epoxy, may be used to completely encapsulate the second member 200 and its fastener 285 to provide a corrosive resistent fastening element. The film is only partially shown in FIG. 5A and designated by the number 290. However, it is understood that the film envelopes the entire second member 200 and fastener 285 and penetrates the recess defined by the magnet 230 to provide a water tight, corrosion resistance structure. A similar film may be used to cover the first member 100. Further, this waterproof film may be used to encapsulate the second and/or first members of all of the embodiments of the invention. As a non-limiting example, the waterproof film 290 is also partially shown in FIG. 2.

Figure 5C:
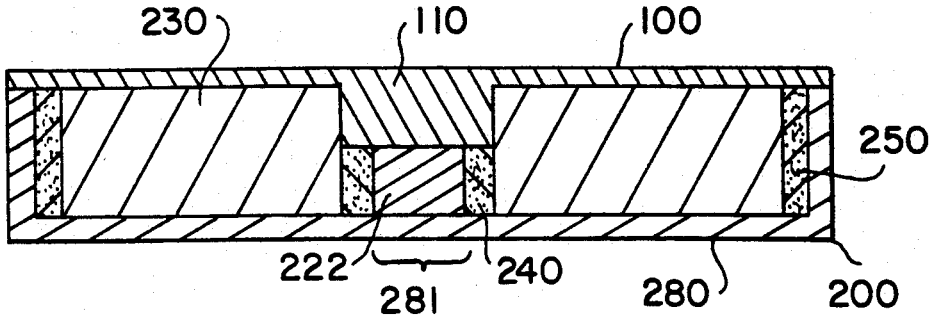

FIG. 5C illustrates yet another modification of the FIG. 1 first embodiment in which the protruding segment 110 has a diameter so as to just fit within the magnet aperture of magnet 230 and makes contact, upon closure of the latch, with the top surfaces of both the center section 222 and the first segment 240. In this case, substantially all of the space between the projecting segment 110 and the inner surface of the magnet 230 defining the magnet aperture is occupied (upon latch closure) either by the projecting segment 110 or the combination of the center section 222 and first segment 240. A small clearance between segment 110 and magnet 230 (not shown) may also be provided to make possible easier mating of the first and second members.

Figure 6A:
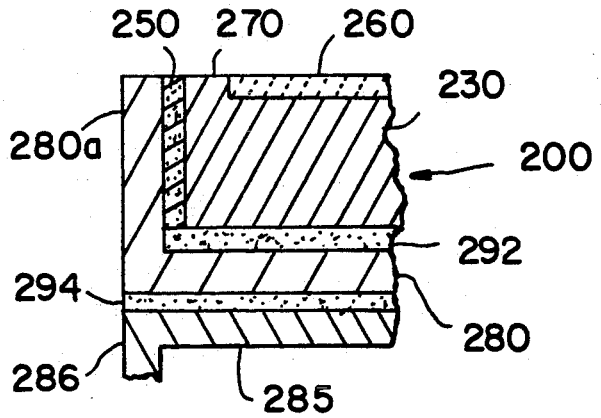
FIGS. 6A–6G illustrate construction details of a modification of the FIG. 1 preferred embodiment.

FIG. 6A illustrates an enlarged view of a portion of second member 200. In FIG. 6A, magnet 230 and second segment 250 are secured to backing plate 280 using an adhesive 292 layer; however, any other fastening technique can be used to secure the backing plate 280. For example, instead of an adhesive layer, these elements may be secured by friction in a close mechanical fit or they may by held in place by magnetic attraction or a combination of mechanical fit and magnetic attraction. Alternately, locking projections or tabs may be provided on rim 280*a* or a retaining cover member can be provided, fitting over the face of the magnet 230 and engaging lockingly with rim 280*a* or the corner between rim 280*a* and backing plate 280. One or more rivets as in FIG. 5A may also be utilized. Many other fastening mechanisms will readily be apparent to one of skill in the art.

FIG. 6A also illustrates a variation of the FIG. 1 preferred embodiment. In this variation, the magnet 230 is covered with a solid, protective covering member 260 made, for example, of ceramic or other solid magnetically insulating material. The covering member 260 extends over most of the surface area of magnet 230 but does not extend over the portion defining the opening of the magnet cavity. Thus, the covering member 260 does not substantially interfere with the magnetic attraction through the central aperture of the magnet 230. A portion of magnet 230 not covered forms an outer rim section 270. Protective covering member 260 not only serves to protect the magnet from physical mechanical damage, but also serves to minimizes the attractive force between first member 100 and second member 200 when the first and second members are not lined up properly for latching. It is only by properly aligning the first and second members that the high magnetic attractive forces will be experienced between the first and second members. In this manner, the covering member 260 assists in the attachment process since the protruding segment 110 of the first member 100 can easily slide over the surface of covering member 260 with minimal attraction to magnet 230 until the protruding segment 110 is proximate to the center of the aperture in magnet 230 and thus near the center section 222 of the second member 200. Covering members 260 may be secured by means of adhesive and/or force fit into place or secured by any other suitable means.

Figure 6B:
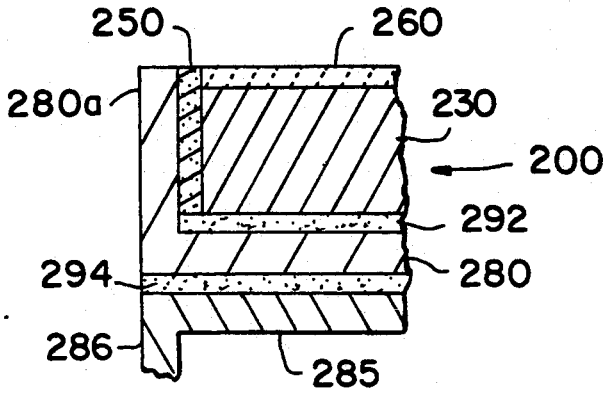
Figure 6C:
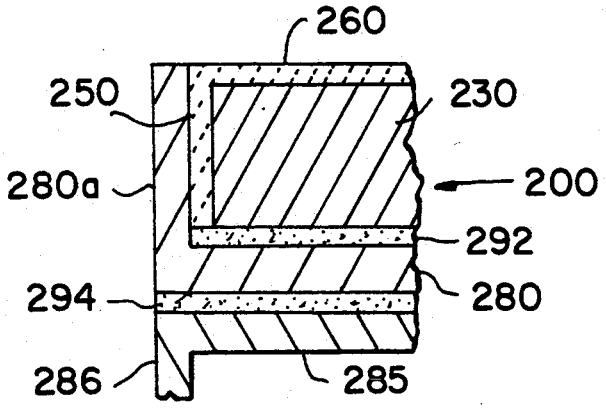
Figure 6D:
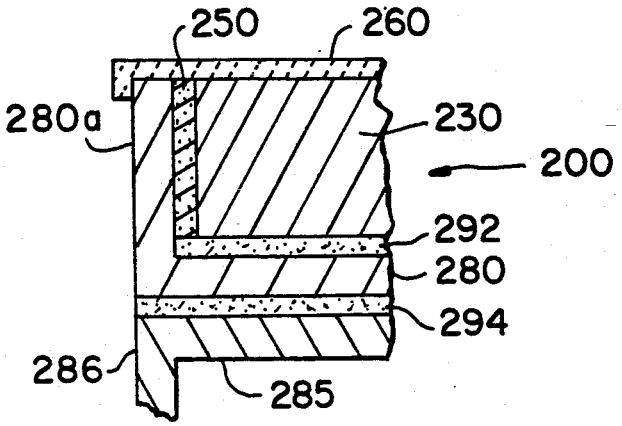

Alternatively, as shown in FIG. 6B, the covering member 260 may extend over the entire uppermost surface of the magnet 230, and magnetic engagement is achieved primarily through the aperture of the magnet 230. As shown in FIG. 6C, the covering member 260 may be formed integral with the second segment 250 so as to enhance corrosive resistant properties of the latch. In yet another modification, the covering member 260 may extend over the entire upper face of the second member 200 and serves as the retaining cover member referred to above. This modification is shown in FIG. 6D wherein the covering member 260 has a lip and is pressure fit over the rim 280*a* of the second member 200. Yet a further modification is shown in FIG. 6E in which the covering member 260 has a side extension 260*a* which extends over the rim 280*a* and onto the back of the backing plate 280 and is secured by tabs 260*b* or similar means adapted to grip the bottom surface of the backing plate 280.

Figure 6E:
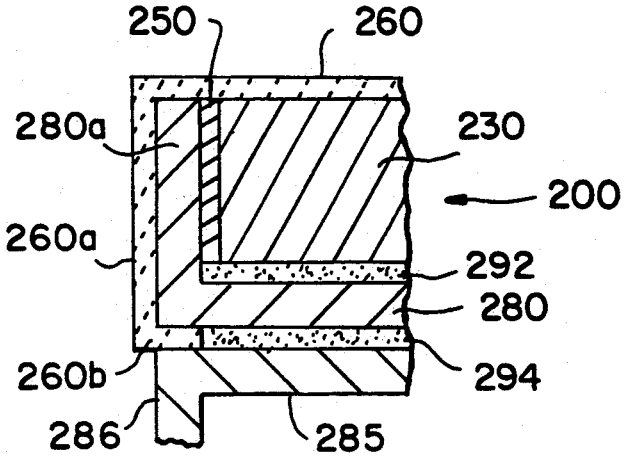
Figure 6F:
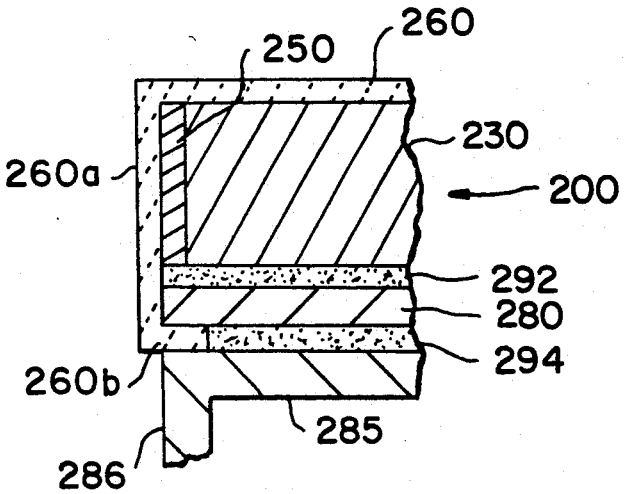
Figure 6G:
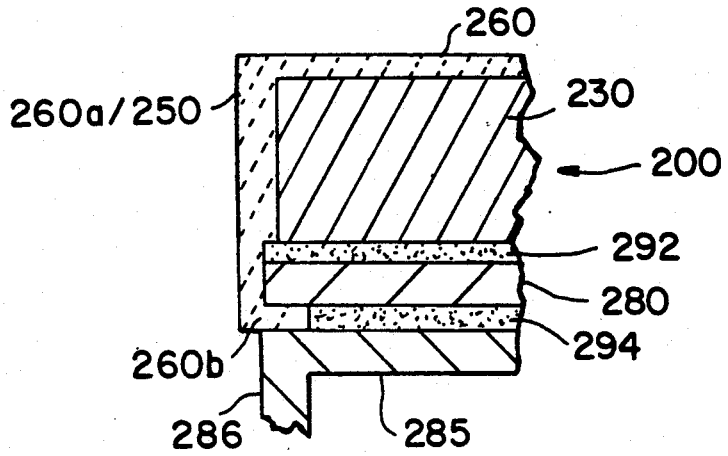

FIG. 6F is similar to FIG. 6E but has the rim 280*a* omitted. In FIG. 6G, the rim 280*a* is omitted and the covering member 260, its side extension 260*a* and the second segment 250 are all integrally formed. The side extension and second segment are indicated by the designation 260*a*/250.

In FIGS. 6A–6G, the backing plate 280 is shown secured to fastener 285 via an adhesive layer 294. The fastener 285 is only partially shown, but is similar to that illustrated in FIG. 5A.

The various cover members shown in FIGS. 6A–6G, are preferably made of magnetically-insulating material; however, materials which are magnetically attractable to a greater or lesser degree can also be used. If magnetically attractable materials are employed in the construction of the covering member 260, it is desirable to provide them with a smooth outer surface to facilitate sliding of projection 110 over the surface of second member 200 during the process of aligning the closure.

In all of the modifications shown in FIGS. 6A–6G, a water proof sealant may be applied as in the case of FIG. 5A.

Still further modifications of the first embodiment of the invention are shown in FIGS. 7 and 8. FIG. 7A is similar to FIG. 1 but omits the rim 280*a* of the backing plate 280. Further, an adhesive layer 292 is shown between the backing plate 280, magnet 230, first segment 240, second segment 250 and center section 222. FIG. 7B is similar to that of FIG. 7A but includes a ring member 130 on the first member 100. FIG. 7C is similar to that of FIG. 7A omits the second segment 250. FIG. 7D is similar to that of FIG. 7C but includes the ring member 130 on the first member 100. The embodiment of FIG. 7E is similar to that shown in FIG. 1 except that the top portions of the rim 280*a* and second segment 250 extend upward to be coextensive with the top surface of first member 100. In this case the diameter of first member is smaller than in FIG. 1 so that the first member 100 fits within the inner periphery of the second segment 250. In FIG. 7F, the top portion of the rim 280*a* is coextensive with the top of the first member 100, but the second segment 250 has a top portion which ends below first member 100. In this case, the diameter of the first member 100 is slightly smaller than the inner diameter of the rim 280*a*.

Figure 7A:
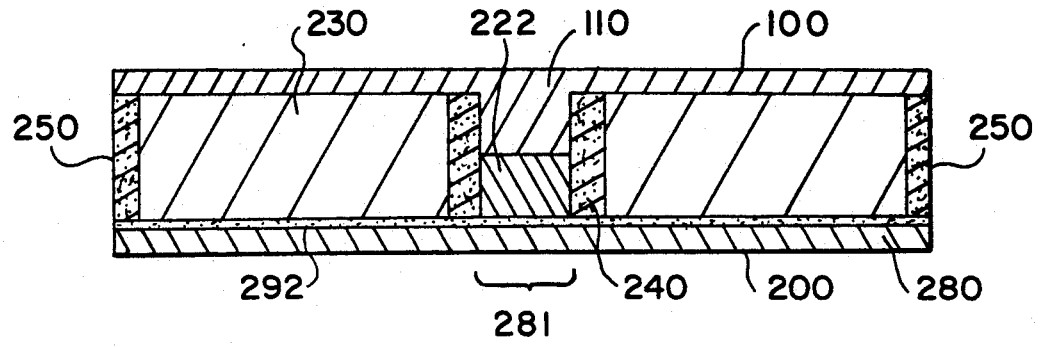
FIGS. 7A-7I illustrate cross sections of other modifications of the first preferred embodiment of the invention.
Figure 7B:
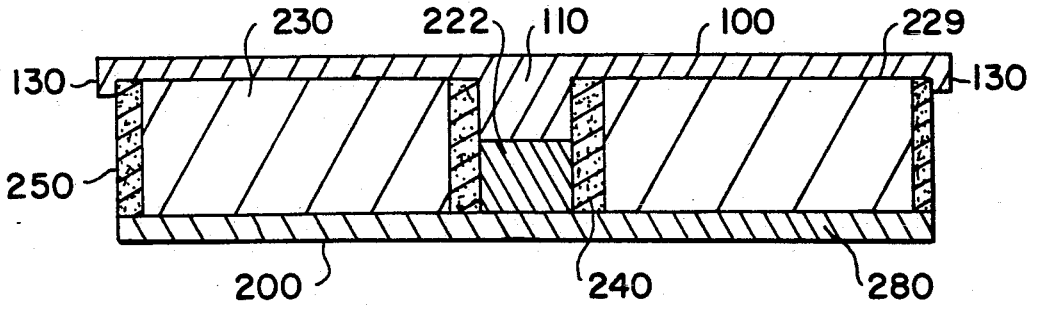
Figure 7C:
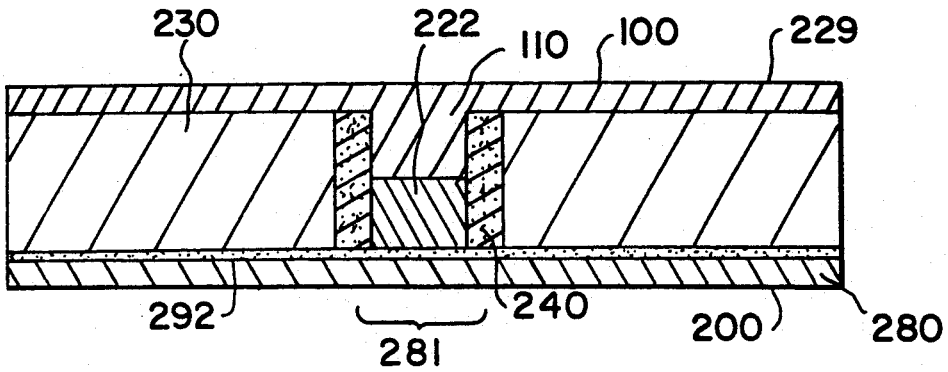
Figure 7D:
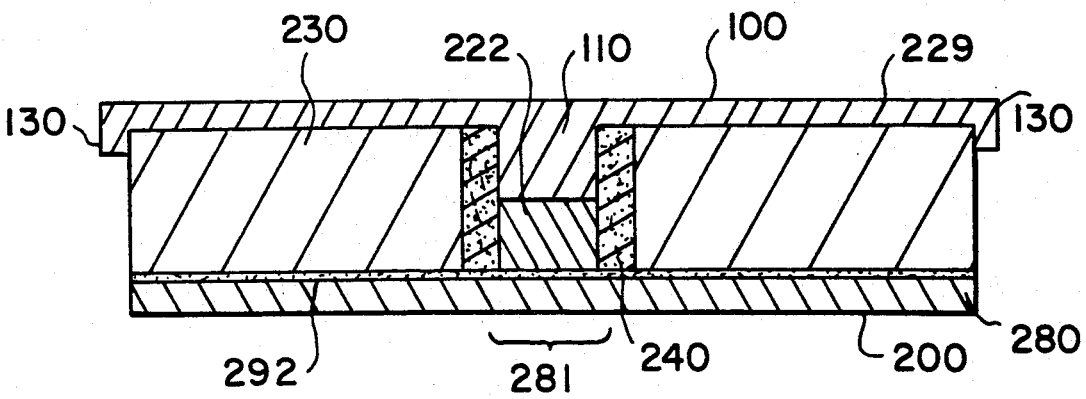
Figure 7E:
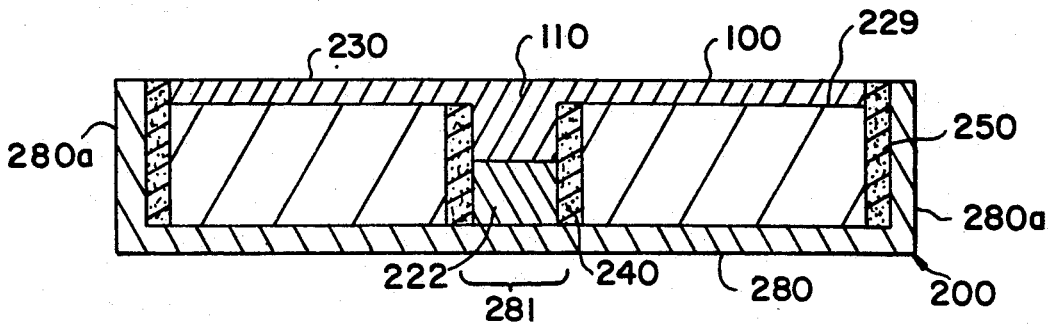
Figure 7F:
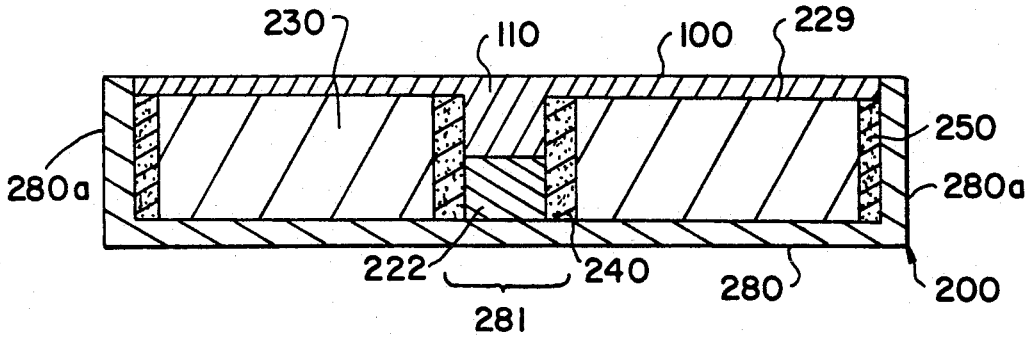
Figure 7G:
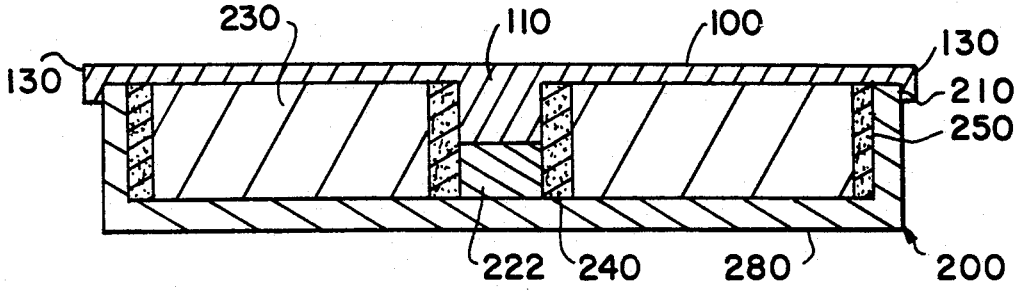

FIG. 7G is similar to FIG. 1 but shows the first member having a ring member 130 fitting over and surrounding the rim 280*a*. The ring member 130 as well as the protruding segment 110 (FIG. 1) may generically be termed a "protrusion."

Figure 8A:
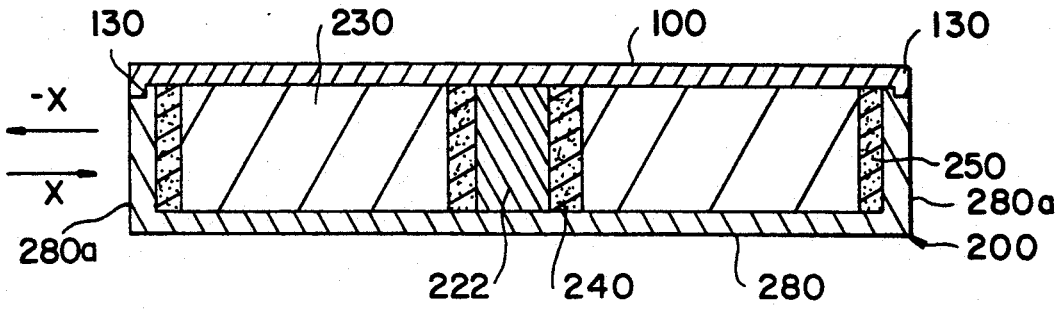
FIGS. 8A-8E illustrates cross sections of yet further modifications of the first preferred embodiment of the invention.
Figure 8B:
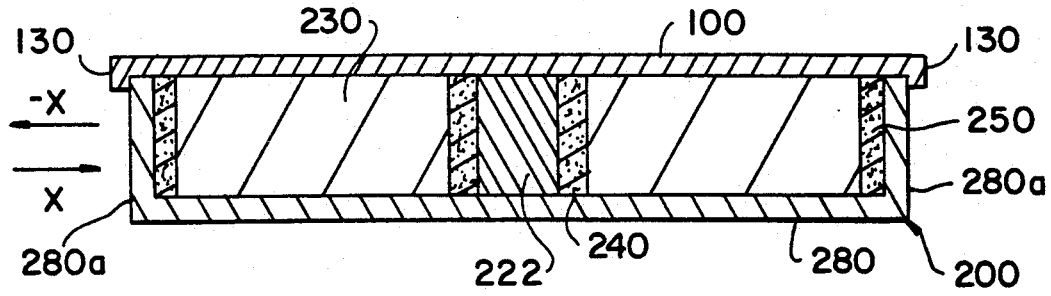
Figure 8C:
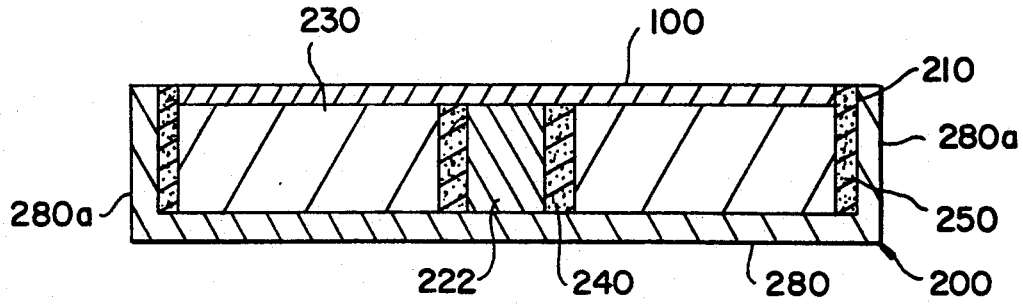
Figure 8D:
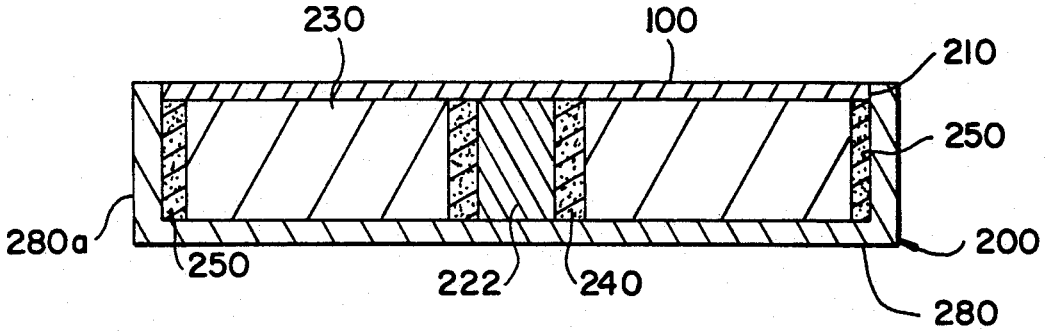

FIG. 8A shows an alternate modification of the first embodiment of the invention in which the first member 100 does not have the protruding segment 110 and in which the center section 222 as well as the first segment 240 extend upwardly so as to be coextensive with the top surface of the magnet 230. Instead of the protruding segment 110, the first member 100 contains a ring member 130 which is set into a shoulder formed in the top portion of the rim 280*a*. Alternately, as shown in FIG. 8B, the ring member 130 can fit over the outer periphery of the rim 280*a*. Further, the first member 100 may fit within the inner periphery of second segment 250, as shown in FIG. 8C, or may fit within the inner periphery of the rim 280*a* as shown in FIG. 8D. In FIGS. 7C, 7F, 7G and 8C–D, the means for preventing sliding movement of the first and second members relative to one another is achieved via the positioning of the first member within the inner periphery of either the rim 280*a* or the second segment 250 of the second member 200.

Figure 8E:
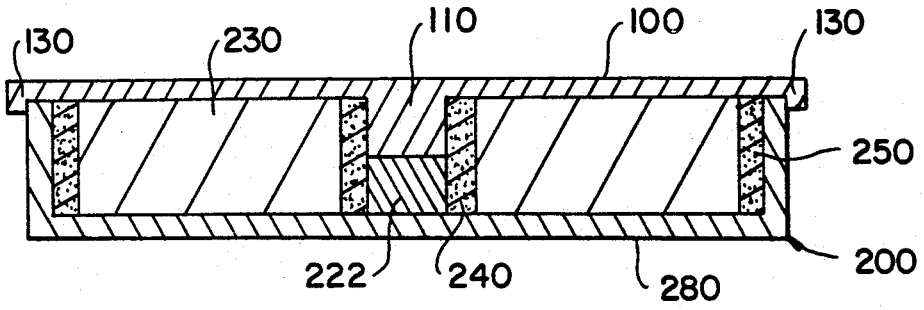

FIG. 8E illustrates yet another modification of the FIG. 1 embodiment in which both a protruding segment 110 as well as a ring member 130 are utilized as a means for securing the first and second members from relative sliding (transverse) movement with respect to one another.

Figure 9A:
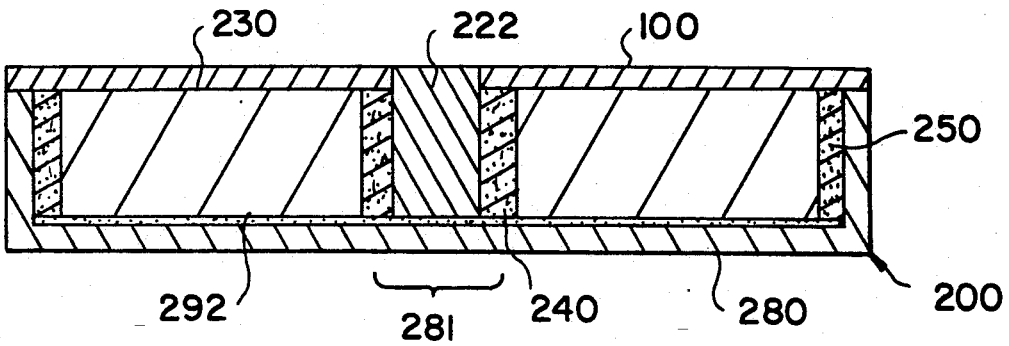
FIGS. 9A and 9B show additional modifications of the first preferred embodiment of the invention.
Figure 9B:
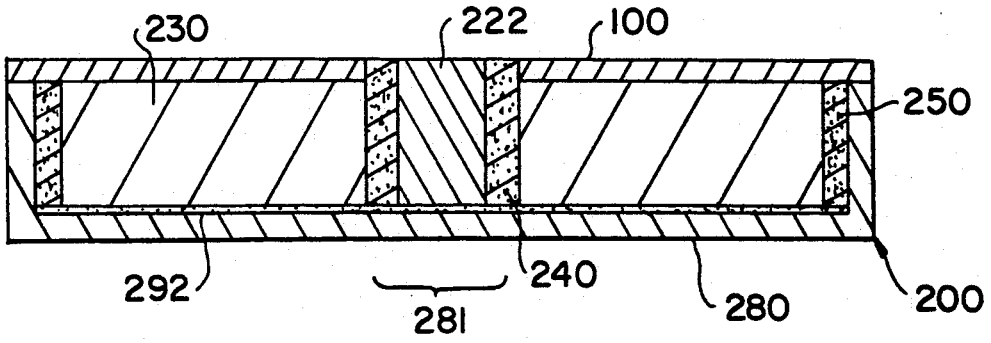

FIGS. 9A and 9B show yet another modification of the first embodiment of the invention. In FIG. 9A, first member 100 does not have a protruding member 110 but rather has an aperture therethrough. The center section 222 of the second member 200 extends through the aperture of the first member 100 thereby providing a means for securing the first and second members against lateral (radial) movement relative to one another. In FIG. 9B, the first segment 240 as well as the center section 222 extend through the aperture in the first member 100.

Depending upon the specific application, the first member can contain only the protruding segment 110 as illustrated in FIG. 1, only ring member 130 as illustrated in FIGS. 8A and 8B, or both protruding segment 110 and ring member 130, as illustrated in FIG. 8E.

In various embodiments of the invention, center section 222, first segment 240, magnet 230, and second segment 250 are integrally bonded together to eliminate cracks and crevices in which caustic materials would otherwise accumulate. This integrally bonded structure can be achieved by gluing these members together in a manner such that the glue fills any void spaces between the various elements.

Figure 10:
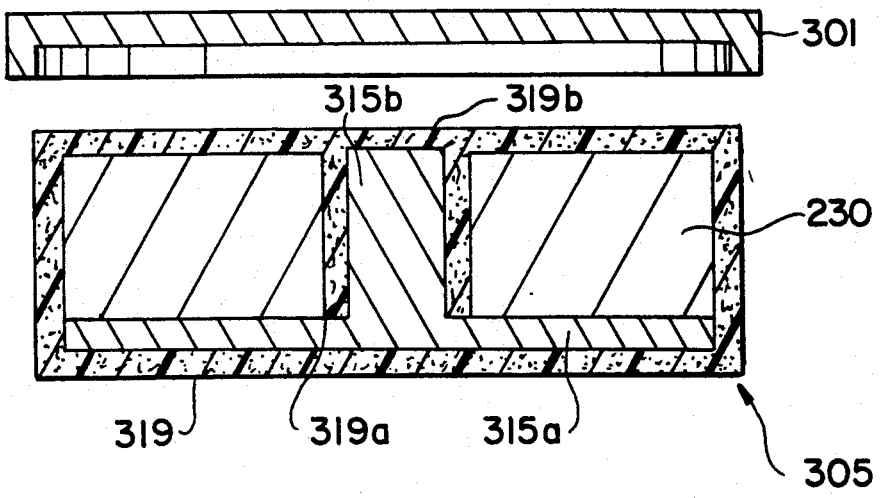
FIG. 10 illustrates a cross sectional view of another modification of the first embodiment of the invention.

Alternatively, FIG. 10 illustrates yet another modification of the first embodiment of the invention in which a first member 301 is shown disposed above a second mating member 305. The second member 305 includes magnet 230 as in the previous embodiments, but includes backing plate 315*a* and center section 315*b*, which may be integrally formed. The entire second member is now shown with an outer protective film 319, such as an epoxy layer which not only serves the function of the waterproof film 290 of FIGS. 2 and 5A, but also includes the first magnetically insulating material 240 of, for example, FIG. 1, and/or may also optionally serve the function of the protective covering layer 260, depending on its thickness and composition. The portion of the protective film 319 disposed between the center section 315*b* and the magnet 230 is designated by the number 319*a*. Further, the top surface of the center section 315*b* may be coated with a thinner layer of the protective film as shown at 319*b*. This embodiment of the invention is advantageous for applications where the latch may be subject to contamination by particulate matter, since it eliminates crevices where magnetically-attractable debris might collect.

The latch can be manufactured by a wide variety of fabrication techniques. A multi-stage injection molding process, illustrated in FIG. 11, can be used to form an integrally bonded second member 200. In this figure, a four stage injection molding process is employed to fabricate the latch. It is understood that FIG. 11 illustrates only one of many possible techniques to manufacture the latch.

Figure 11:
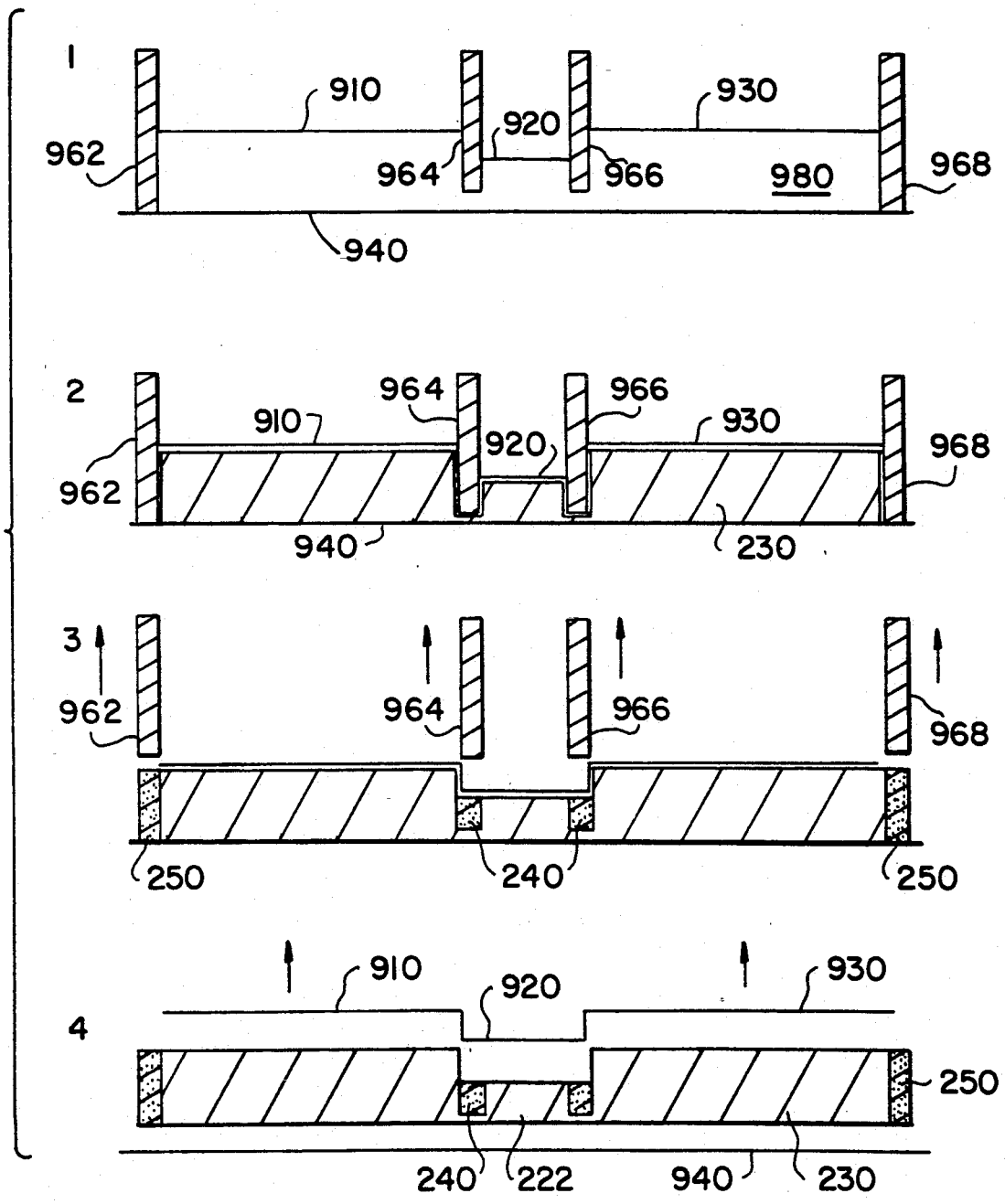
FIG. 11 illustrates one technique for making an alternate form of the FIG. 1 preferred embodiment.

In FIG. 11, step 1, a mold is formed by slides 962, 964, 966, and 968; bottom portion 940; and top portions 910, 920, and 930. A space 980 is defined by these boundaries.

In step 2, magnetic material is injected into space 980 to form magnet 230. The magnetic material is subsequently subjected to a magnetic field to line-up the poles of the magnet in the desired direction.

In step 3, slides 962, 964, 966, and 968 are withdrawn as indicated by the arrows in step 3 of FIG. 11. The voids left after the slides have been withdrawn are then filled with insulating material to form segments 240 and 250. Finally, in step 4 of FIG. 11, boundaries 910, 920, 930, and 940 are withdrawn. The process illustrated in FIG. 11 thus ensures that center section 222, solid insulating first segment 240, magnet 230, and solid insulating second segment 250 are integrally bonded together without any cracks and crevices. It is noted that in FIG. 11 the magnet 230 and center section 222 are integrally formed as one piece in the molding process. While such an integral construction is preferable in the molding operation, discrete elements may likewise be employed, as in FIGS. 1–9. It is understood that in embodiments of the invention in which the magnet 230 and center section 222 are integral with one another, the magnet 230 does not have an aperture therethrough. In such a case, the magnet may be said to have a cavity therein in which both the center section 222 and the first segment 240 are positioned. The term "cavity" is generic to all embodiments and modifications of the invention and is intended to include both a through-hole (aperture) and also a recess.

Figure 12A:
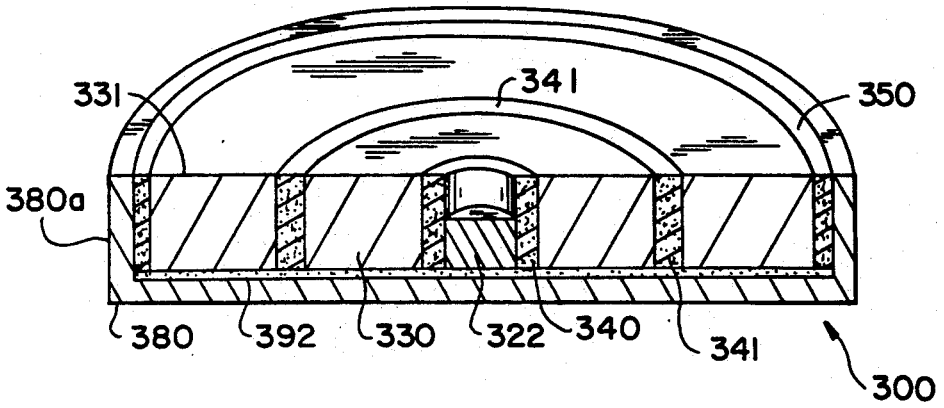
FIG. 12A illustrates a perspective view of the second member of the latch in a second preferred embodiment of the invention.

FIG. 12A illustrates a second member 300 of a second preferred embodiment of the invention. The second member 300 of FIG. 12A is used with the first member 100 illustrated in FIG. 1. The second member of the second preferred embodiment includes a first magnet 330 (corresponding to magnet 230 of FIG. 2), a segment 340 of solid insulating material (corresponding to first segment 240 of FIG. 2), a center section 322 (corresponding to section 222 of FIG. 2) and an outer segment 350 of solid insulating material (corresponding to second segment 250 of FIG. 2). In addition, the FIG. 12A embodiment includes a second magnet 331 which is separated from magnet 330 by a segment of solid magnetically insulating material 341. An adhesive layer 392 shown greatly enlarged may be used to secure the magnets and segments to a backing plate 380 having a rim 380*a*. Dividing the magnet up into various sections separated by solid magnetically insulating material further enhances the latching force of the magnetic latch by further concentrating magnetic force in localized areas. When the second member 200 illustrated in FIG. 4 is compared with a similarly sized second member 300 illustrated in FIG. 12A, the FIG. 12A second preferred embodiment has a greater latching force.

It is understood that section 322 and magnets 330 and 331 may be integral with one another or may be discretely formed. Further, any two of these elements may be integrally formed with the third being discrete.

Figure 12B:
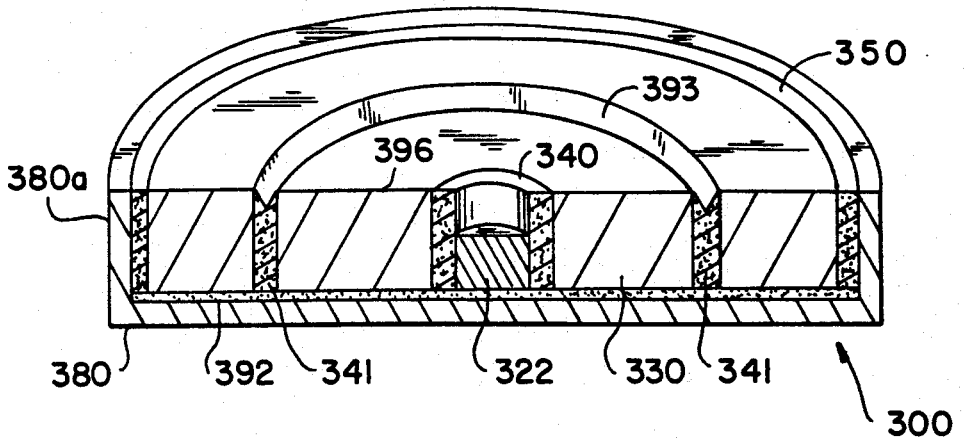
FIGS. 12B and 12C illustrate perspective views of modifications of the second member of the FIG. 12A preferred embodiment.

FIG. 12B illustrates a modification of the FIG. 12A preferred embodiment. In FIG. 12B, a groove 393 is provided with the magnetically insulating material 341. The groove serves to cooperate with a ridge 140 of the first member 100 as illustrated in FIG. 12D to assist in the alignment and securing of the first and second members. The position of the groove need not be within the region of the magnetically insulating material 341.

Figure 12C:
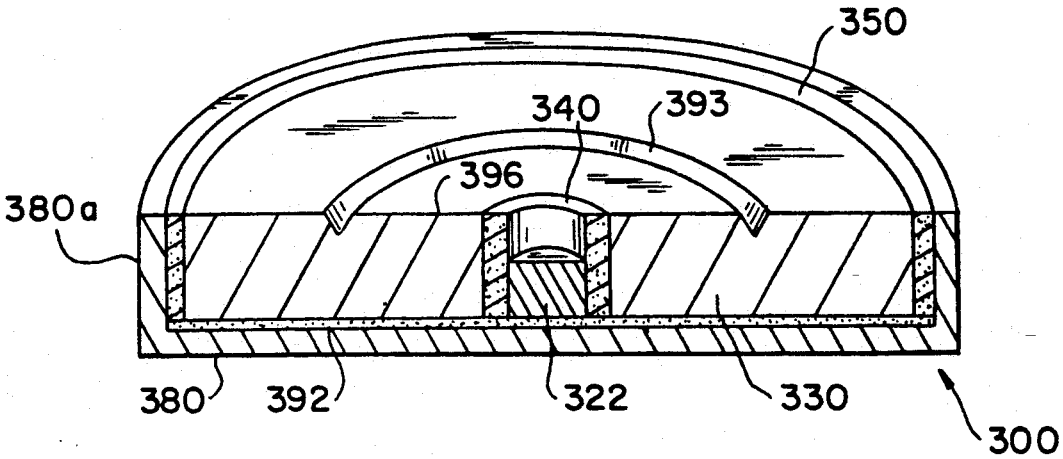
Figure 12D:
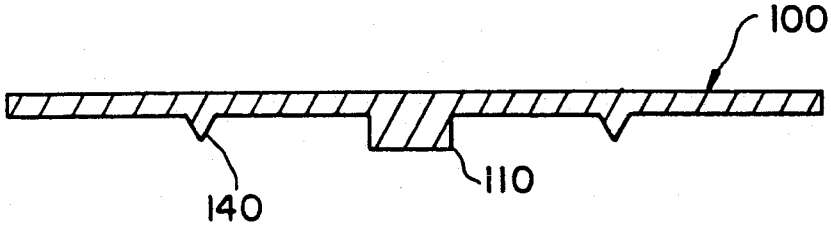
FIG. 12D is a cross section of the first member of the latch for use in the second embodiment of the invention as illustrated in FIGS. 12B and 12C.
Figure 12E:
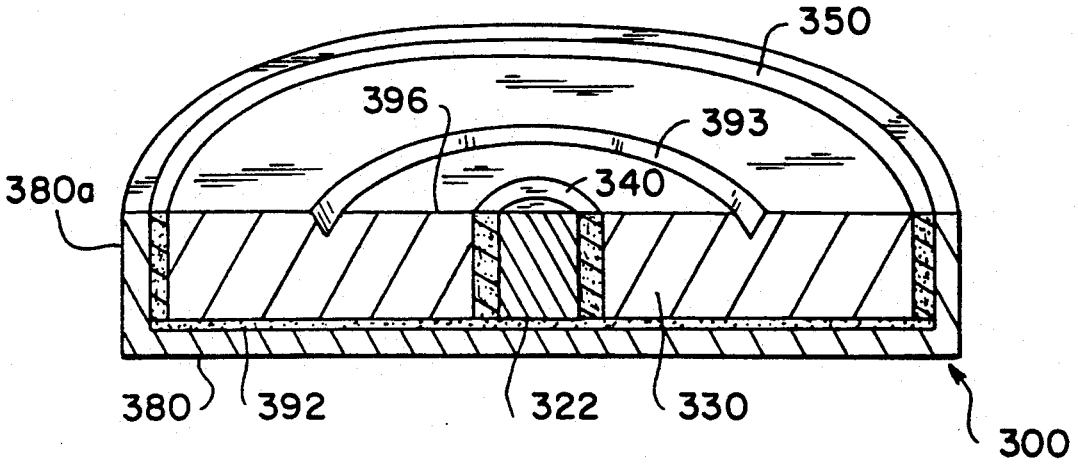
FIGS. 12E and 12F illustrated a modification of the embodiment of FIGS. 12C and 12D.
Figure 12F:
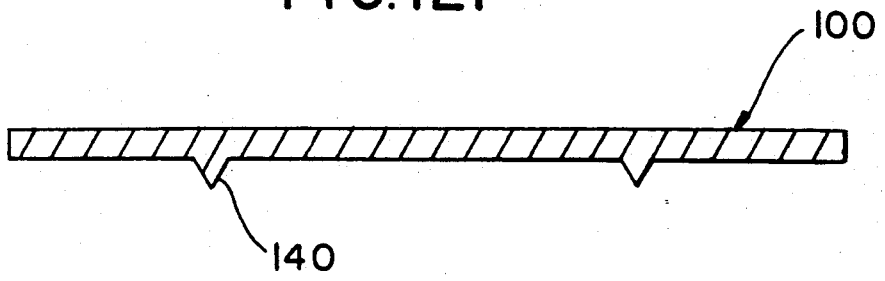

FIG. 12C shows a modification of the embodiment of FIG. 12B wherein the magnetically insulating material 341 is omitted and the magnet 330 occupies the entire space between the first segment 240 and the second segment 250. Groove 393 is cut into the magnet 330 and cooperates with the ridge 140 of the first member 100 as shown in FIG. 12D. In a modification to this embodiment as shown in FIGS. 12E and 12F, the center section 322 may be formed to extend to the top surface of the first segment 340 so as to be coextensive with the top surface of the magnet 330. In such a case, the protruding segment 110 is omitted as in FIG. 12F. Further, the first member may also include a ring member as in ring member 130 of FIG. 7B.

Figure 7H:
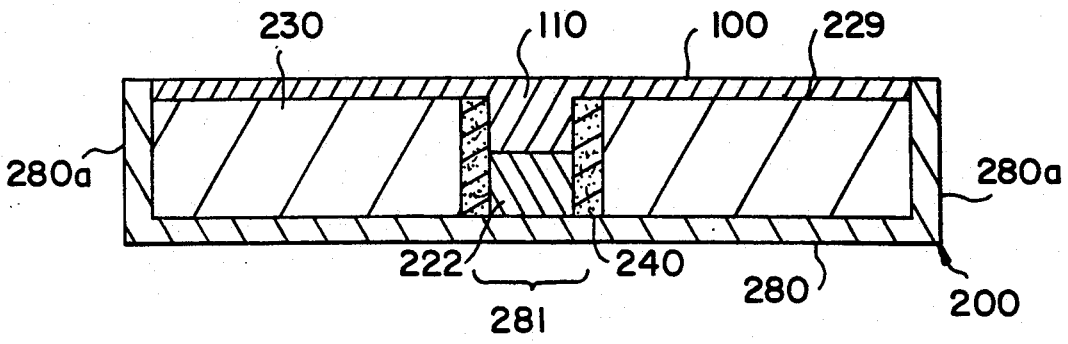
Figure 7I:
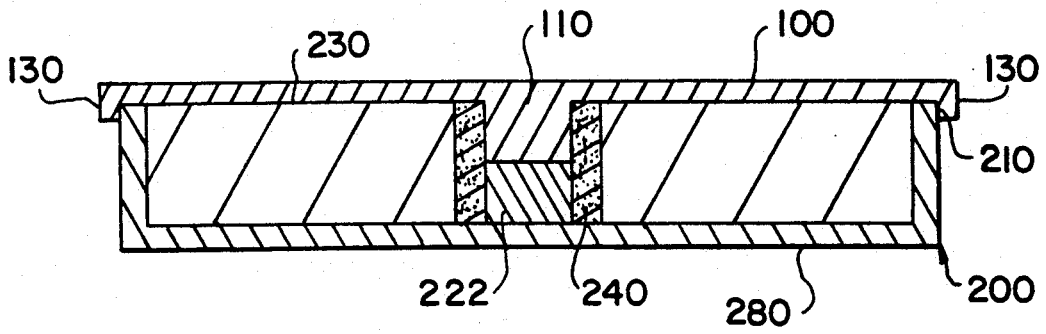

Yet a further modification is illustrated in FIGS. 7H and 7I which are similar to the embodiments of FIGS. 7F and 7G respectively but wherein the second segment 250 is omitted. In FIG. 7I, the ring member 130 may also be omitted.

Figure 13:
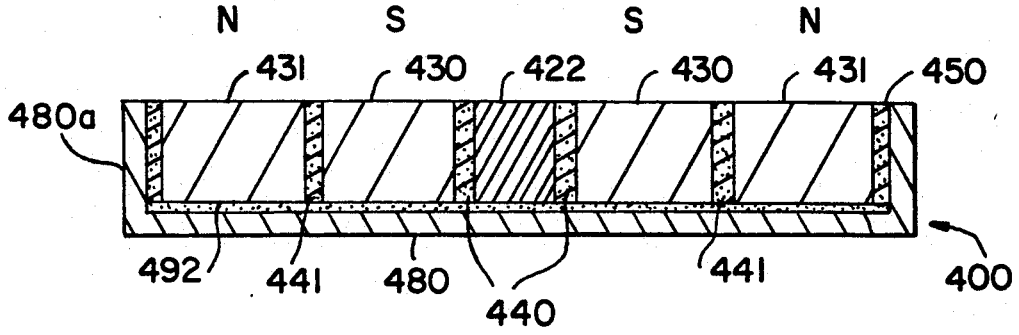
FIG. 13 illustrates a cross section of a third preferred embodiment of the invention.

FIG. 13 illustrates a third preferred embodiment. The FIG. 13 embodiment is similar to the FIG. 12A embodiment with corresponding elements identified by a number in the 400's, with the same tens and units value as in FIG. 12A. In the third preferred embodiment, the polarities of first magnet 430 and second magnet 431 are reversed with respect to each other to increase the attraction force. Also, in the FIG. 13 embodiment, center section 422 has the same depth as the depth of first magnet 430 and second magnet 431, i.e., it is coextensive therewith. In this embodiment, the first member 100 would have the form of that shown in FIG. 8B.

Figure 14:
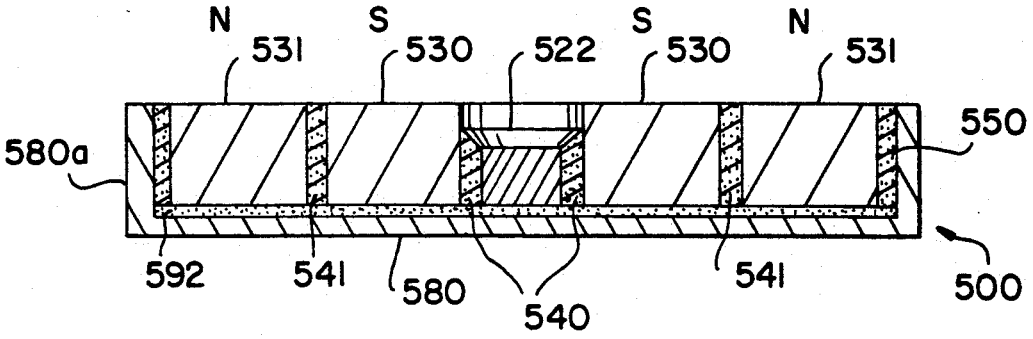
FIG. 14 illustrates a cross section of a fourth preferred embodiment of the invention.

FIG. 14 illustrates a fourth preferred embodiment, with corresponding elements in the 500's. The FIG. 14 embodiment is similar to the FIG. 13 embodiment except that in the FIG. 14 embodiment center section 522 is recessed. The first member 100 could now take several forms such as those shown in FIGS. 1, 7C, 7D and 7E.

Figure 15:
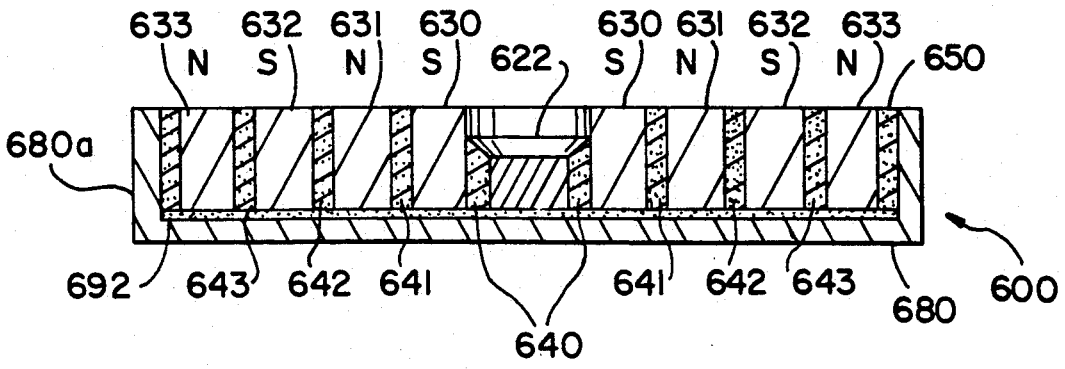
FIG. 15 illustrates a cross section of a fifth preferred embodiment of the invention.

FIG. 15 illustrates a fifth preferred embodiment, with corresponding elements in the 600's. The FIG. 15 embodiment includes four magnets 630, 631, 632 and 633. Use of multiple magnets further increases the available latching force. In FIG. 15, the polarities of adjacent magnets are reversed to further increase the latching force.

Figure 16:
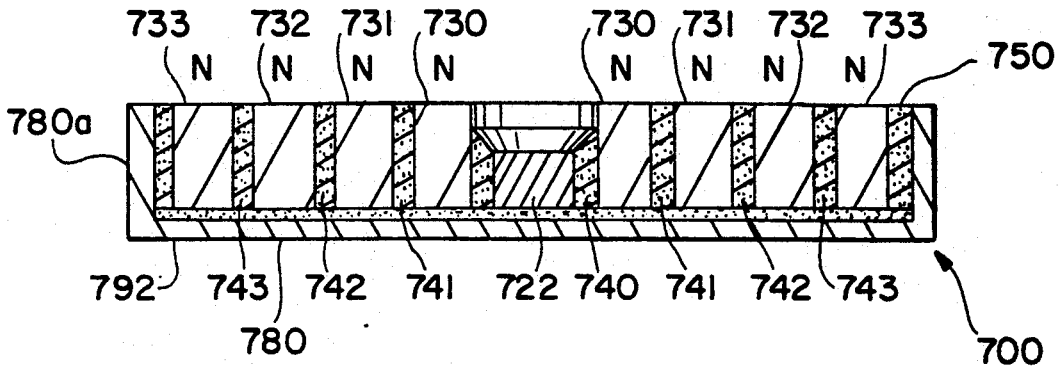
FIG. 16 illustrates a cross section of a sixth preferred embodiment of the invention.

FIG. 16 illustrates a sixth preferred embodiment which is similar to the FIG. 15 fifth preferred embodiment, with corresponding elements in the 700's, except that the polarities are not reversed.

Figure 17:
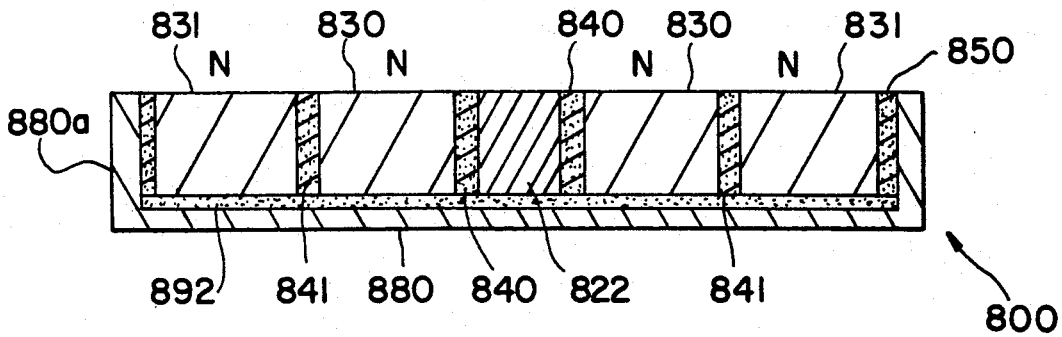
FIG. 17 illustrates a cross section of a seventh preferred embodiment of the invention.

FIG. 17 illustrates a seventh preferred embodiment which is similar to the FIG. 13 third preferred embodiment with corresponding elements in the 800's except that the polarities of the magnets are not reversed.

Figure 18:
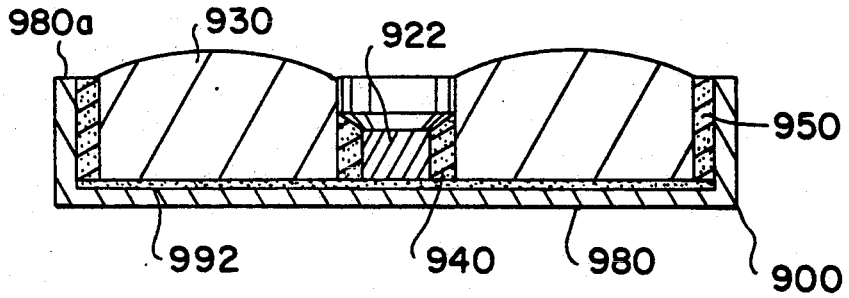
FIG. 18 illustrates a cross section of an eighth preferred embodiment of the invention.
Figure 19:
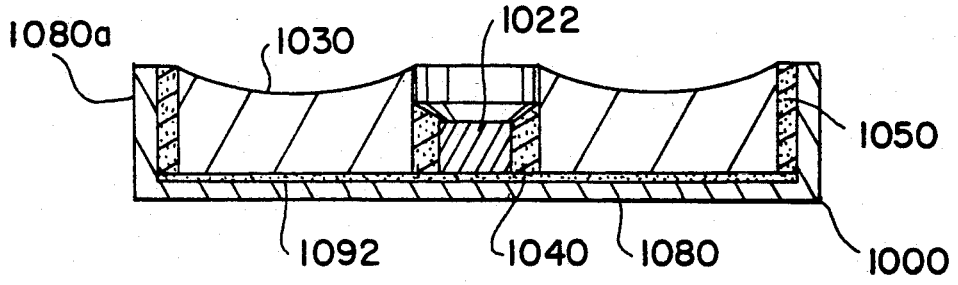
FIG. 19 illustrates a cross section of a ninth preferred embodiment of the invention.
Figure 20:
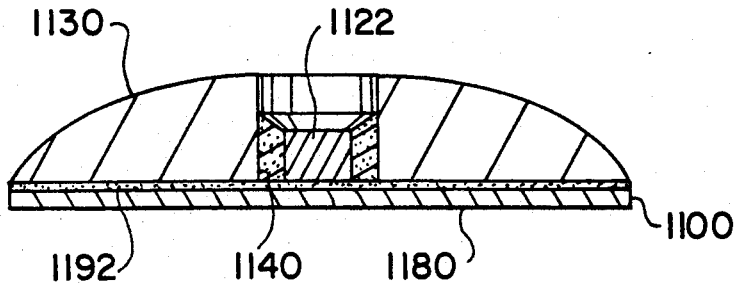
FIG. 20 illustrates a cross section of a tenth preferred embodiment of the invention.

Although the invention has been described with respect to certain preferred embodiments, it is understood that various modifications and improvements to the invention may be made by those skilled in the art without departing from the scope of the invention, as defined by the appended claims. For example, the surfaces of the magnet(s) can be curved rather than flat as illustrated in FIGS. 18, 19, and 20. In these figures number in the 900's, 1000, and 1100 series have been used respectively to identify the corresponding elements as in previous figures. Moreover, the surfaces of the magnets in FIGS. 7–9 and 12–20 may be covered with a covering member similar to covering member 260 of FIG. 6A so as to leave a small perimeter of the outer magnet uncovered or as in FIGS. 6B–6G so as to completely cover all the magnet upper surfaces. For the multi-magnet embodiments of FIGS. 12–20, the covering member may cover some or all or the solid magnetically insulating members as well (for example both members 341 and 350 or only member 341 of FIG. 12A) or only the magnet portions, leaving the solid magnetically insulating members exposed.

It is noted that the magnets utilized in the embodiments described above may be fabricated using any conventional technique including the use of plastics having magnetic particles embedded therein. For example, permanent magnets made of hard magnetic powder of ferrite, alnico, rare-earth etc. may be solidified with a synthetic resin and then magnetized.

It is further noted that the fasteners and their associated prongs as shown in FIGS. 5 and 6 may be used in all of the embodiments and are shown as non-limiting examples of a mechanism to attach the magnetic latch to the desired article, e.g., handbag, article of clothing etc. Other potential fastening means include various types of riveting means, holes in the closure (housing) or an embedded or integral loop provided to facilitate attachment by sewing, hook-and-eye means, adhesives of various types, and various other fastening means know to those skilled in the art.

In all of the embodiments described above, a water proof sealing layer (as in FIG. 5A) may be employed to prevent corrosion of the various latch components.

What is claimed is:

1. A magnetic latch, comprising:

a first member including magnetically attractable material; and a second member including:

a first magnet to attract said first member, said first magnet defining a cavity; and a single solid non-magnetic member arranged inside of said cavity, said single solid non-magnetic member concentrating magnetic force within said cavity;

said first and second members including means for preventing the lateral movement of the first member relative to the second member when said first and second members are latched together said means for preventing lateral movement comprises a protrusion formed on said first member and extending into the cavity of said first magnet.

2. A magnetic latch as set forth in claim 1, further comprising a backing plate secured to a back surface of said first magnet, said back surface opposite a magnet surface adjacent said first member, said backing plate extending over at least a portion of said back surface of said first magnet and extending over a region of said first magnet including said cavity.

3. A magnetic latch as recited in claim 2, further comprising a fastener attached to said backing plate for securing said second member to an object.

4. A magnetic latch as recited in claim 2, wherein said backing plate covers a surface of said center section substantially coplanar with said first magnet back surface.

5. A magnetic latch as recited in claim 4, wherein said first magnet has a top surface facing said first member and an exterior surface between said top and back surfaces, wherein said second member further includes:

a rim extending over the exterior surface of said first magnet and connected to said backing plate.

6. A magnetic latch as set forth in claim 2, wherein said backing plate extends over substantially the entire back surface of said first magnet.

7. A magnetic latch as set forth in claim 6, wherein said backing plate comprises ferromagnetic material.

8. A magnetic latch as set forth in claim 2, wherein said backing plate comprises ferromagnetic material.

9. A magnetic latch as recited in claim 2, 6 or 8, wherein said cavity is in the form of a through-hole and said backing plate completely covers said through-hole.

10. A magnetic latch as recited in claim 2, 6 or 8, further comprising a rim, connected to said backing plate.

11. A magnetic latch as set forth in claim 1, 2, 6, 8 or 7, wherein said second member further comprises:

an additional solid non-magnetic member arranged on an outer periphery of said first magnet.

12. A magnetic latch as set forth in claim 11, wherein said first magnet has a surface, facing said first member, which is substantially completely covered with a solid, protective covering member.

13. A magnetic latch as set forth in claim 1, 2, 6, 8 or 7, wherein said protrusion is formed at least partially from ferromagnetic material.

14. A magnetic latch as set forth in claim 1, 2, 6, 8 or 7, wherein said second member further comprises:

a center section arranged inside of said cavity such that said solid non-magnetic member is located between said first magnet and said center section.

15. A magnetic latch as set forth in claim 14, wherein said center section is formed at least partially from ferromagnetic material.

16. A magnetic latch as recited in claim 14, wherein said magnet has an upper surface and said single solid non-magnetic member extends throughout the entire longitudinal length of said cavity and is coextensive with the upper surface of said magnet.

17. A magnetic latch as set forth in claim 1, 2, 6, 8 or 7, wherein said first magnet has a surface, facing said first member, which is substantially completely covered with a solid, magnetically insulating protective covering member.

18. A magnetic latch as set forth in claim 1, 2, 6, 8 or 7, wherein said cavity is a through-hole.

19. A magnetic latch as set forth in claim 1, 2, 6, 8 or 7, wherein said first magnet is donut-shaped, and said cavity is a through-hole.

20. A magnetic latch as recited in claim 1, 2, 6, 8 or 7 further including a water impervious film encapsulating substantially the entire external surface of at least one of said first and second members.

21. A magnetic latch as recited in claim 1, 2, 6, 8 or 7, wherein said first magnet cavity is positioned within a central region of said first magnet.

22. A magnetic latch as set forth in claim 1, wherein said solid non-magnetic member is in the shape of one of an open-ended cylinder or an open-ended polygon.

* * * * *